US007057480B2

(12) United States Patent
Pance et al.

(10) Patent No.: US 7,057,480 B2
(45) Date of Patent: Jun. 6, 2006

(54) CROSS-COUPLED DIELECTRIC RESONATOR CIRCUIT

(75) Inventors: Kristi Dhimiter Pance, South Boston, MA (US); Eswarappa Channabasappa, Acton, MA (US)

(73) Assignee: M/A-COM, Inc., Lowell, MA (US)

( * ) Notice: Subject to any disclaimer, the term of this patent is extended or adjusted under 35 U.S.C. 154(b) by 0 days.

(21) Appl. No.: 10/268,480

(22) Filed: Oct. 10, 2002

(65) Prior Publication Data

US 2004/0051603 A1 Mar. 18, 2004

Related U.S. Application Data

(60) Provisional application No. 60/411,337, filed on Sep. 17, 2002.

(51) Int. Cl.
*H01P 1/205* (2006.01)
*H01P 1/20* (2006.01)

(52) U.S. Cl. ..... 333/203; 333/219.1; 333/235

(58) Field of Classification Search ..... 333/202, 333/219.1, 212, 235, 203
See application file for complete search history.

(56) References Cited

U.S. PATENT DOCUMENTS

| | | | | |
|---|---|---|---|---|
| 4,138,652 A | | 2/1979 | Nishikawa et al. | 333/251 |
| 4,283,649 A | | 8/1981 | Heinouchi | 310/324 |
| 4,757,289 A | | 7/1988 | Kosugi et al. | 333/209 |
| 5,109,207 A | | 4/1992 | Aizawa et al. | 333/222 |
| 5,614,875 A | | 3/1997 | Jang et al. | 333/202 |
| 5,691,677 A | * | 11/1997 | De Maron et al. | 333/219.1 |
| 5,748,058 A | | 5/1998 | Scott | 333/202 |
| 5,777,534 A | | 7/1998 | Harrison | 333/202 |
| 5,949,309 A | | 9/1999 | Correa | 333/202 |
| 6,087,910 A | | 7/2000 | Matsumoto et al. | 333/202 |
| 6,100,703 A | | 8/2000 | Davidov et al. | 324/631 |
| 6,111,339 A | | 8/2000 | Ohya et al. | 310/358 |
| 6,254,708 B1 | | 7/2001 | Cappabianca | 156/89.12 |
| 6,262,639 B1 | | 7/2001 | Shu et al. | 333/202 |
| 6,337,664 B1 | | 1/2002 | Mayes et al. | 343/749 |
| 6,402,981 B1 | | 6/2002 | Sasaki | 252/62.9 PZ |
| 6,707,353 B1 | | 3/2004 | Yamakawa et al. | 333/202 |
| 6,717,490 B1 | * | 4/2004 | Mayer | 333/202 |
| 2004/0051602 A1 | | 3/2004 | Pance et al. | |

FOREIGN PATENT DOCUMENTS

| | | | |
|---|---|---|---|
| GB | 1376938 | | 12/1974 |
| GB | 1520 472 | | 8/1978 |
| JP | 59202701 | A | 11/1984 |
| JP | 02042898 | A | 2/1990 |
| JP | 02168702 | A | 6/1990 |
| JP | 06061714 | A | 4/1994 |
| JP | 07154116 | A | 6/1995 |
| WO | WO00/70706 | * | 11/2000 |

OTHER PUBLICATIONS

Kishk et al, Conical dielectric resonator antennas for wide band applications, IEEE Transactions on Antennas and Propagation, vol. 50, No. 4, Apr. 2002, pp. 469-474.

* cited by examiner

*Primary Examiner*—Stephen E. Jones

(57) ABSTRACT

A cross-coupled dielectric resonator circuit. Resonator circuits in accordance with the invention may be used to build low-loss compact filters, oscillators, and other circuits, particularly microwave circuits. The resonators are arranged relatively to each other within an enclosure in a very efficient and compact design that enhances adjustability and coupling between adjacent resonators and the cross-coupling of alternate resonators.

29 Claims, 9 Drawing Sheets

CROSS-COUPLED DIELECTRIC RESONATOR CIRCUIT

RELATED APPLICATIONS

The present application is related to commonly assigned, co-pending U.S. provisional patent application Ser. No. 60/411,337 entitled DIELECTRIC RESONATORS AND CIRCUITS MADE THEREFROM filed on Sept. 17, 2002 and commonly assigned, co-pending U.S. non-provisional patent application Ser. No. 10/268,415 entitled DIELECTRIC RESONATORS AND CIRCUITS MADE THEREFROM filed on even date herewith.

FIELD OF THE INVENTION

The invention pertains to dielectric resonator circuits and, more particularly, to cross-coupled dielectric resonator circuits used in circuits such as microwave filters, oscillators, triplexers, antennas, etc.

BACKGROUND OF THE INVENTION

Dielectric resonators are used in many circuits, particularly microwave circuits, for concentrating electric fields. They can be used to form filters, oscillators, triplexers and other circuits. The higher the dielectric constant of the dielectric material out of which the resonator is formed, the smaller the space within which the electric fields are concentrated. Suitable dielectric materials for fabricating dielectric resonators are available today with dielectric constants ranging from approximately 10 to approximately 150 (relative to air). These dielectric materials generally have a magnetic constant of 1, i.e., they are transparent to magnetic fields.

FIG. 1 is a perspective view of a typical dielectric resonator of the prior art. As can be seen, the resonator 10 is formed as a cylinder 12 of dielectric material with a circular, longitudinal through hole 14. Individual resonators are commonly called "pucks" in the relevant trades. While dielectric resonators have many uses, their primary use is in connection with microwaves and, particularly, in microwave communication systems and networks.

As is well known in the art, dielectric resonators and resonator filters have multiple modes of electrical fields and magnetic fields concentrated at different center frequencies. A mode is a field configuration corresponding to a resonant frequency of the system as determined by Maxwell's equations. In a dielectric resonator, the fundamental resonant mode frequency, i.e., the lowest frequency, is the transverse electric field mode, $TE_{01\delta}$ (or TE, hereafter). Typically, it is the fundamental TE mode that is the desired mode of the circuit or system into which the resonator is incorporated. The second mode is commonly termed the hybrid mode, $H_{11\delta}$ (or $H_{11}$, hereafter). The $H_{11}$ mode is excited from the dielectric resonator, but a considerable amount of electric field lays outside the resonator and, therefore, is strongly affected by the cavity. The $H_{11}$ mode is the result of an interaction of the dielectric resonator and the cavity within which it is positioned. The $H_{11}$ mode field is orthogonal to the TE mode field. There also are additional higher modes. Typically, all of the modes other than the mode of interest, e.g., the TE mode, are undesired and constitute interference. The $H_{11}$ mode, however, typically is the only interference mode of significant concern. The remaining modes usually have substantial frequency separation from the TE mode and thus do not cause significant interference with operation of the system. The $H_{11}$ mode, however, tends to be rather close in frequency to the TE mode. In addition, as the frequency of the TE mode is tuned, the center frequency of the TE mode and the $H_{11}$ mode move in opposite directions to each other. Thus, as the TE mode is tuned to increase its center frequency, the center frequency of the $H_{11}$ mode inherently moves downward and, thus, closer to the TE mode center frequency. By contrast, the third mode, commonly called the $H_{12}$ mode, not only is sufficiently spaced in frequency from the TE mode so as not to cause significant problems, but, in addition, it moves in the same direction as the TE mode responsive to tuning.

FIG. 2 is a perspective view of a cross-coupled dielectric resonator filter 20 of the prior art employing a plurality of dielectric resonators 10. The resonators 10 are arranged in the cavity 22 of a conductive enclosure 24. The conductive enclosure 24 typically is rectangular, as shown in FIG. 2. Microwave energy is introduced into the cavity via an input coupler 28 coupled to a cable, such as a coaxial cable. The energy may then be coupled to a first resonator (such as resonator 10*a*) using a coupling loop. Conductive separating walls 32 separate the resonators from each other and block (partially or wholly) coupling between physically adjacent resonators 10. Particularly, irises 30 in walls 32 control the coupling between adjacent resonators 10. Conductive walls without irises generally prevent any coupling between the resonators separated by the walls, while walls with irises allow some coupling between these resonators. Specifically, conductive material within the electric field of a resonator essentially absorbs the field coincident with the material and turns it into a current in the conductor so that the field does not pass through to the other side of the wall. In other words, conductive materials within the electric fields cause losses in the circuit.

Conductive adjusting screws (not shown) coupled to the enclosure may be placed in the irises to further affect the coupling of the fields between adjacent resonators and provide adjustability of the coupling between the resonators, but are not used in the example of FIG. 2. When positioned within an iris, a conductive screw partially blocks the coupling between adjacent resonators permitted by the iris between them. Inserting more of the conductive screw into the iris reduces coupling between the resonators while withdrawing the conductive screw from the iris increases coupling between the resonators.

A cross-coupler 34 having a metal probe 34*a* extending through a non-conductive bushing 34*b* is used to couple resonators separated by walls without irises to obtain more optimum filter transfer functions. The non-conductive bushing 34*b* electrically isolates the probe 34*a* from the enclosure 24 so that electric fields coincident to the probe 34*a* are not absorbed by the walls of the enclosure, but rather are passed from one end of the probe 34*a* to the other for coupling resonators adjacent the ends of the probe 34*a*.

By way of example, the field of resonator 10*a* couples to the field of resonator 10*b* through iris 30*a*, the field of resonator 10*b* further couples to the field of resonator 10*c* through iris 30*b*, and the field of resonator 10*c* further couples to the field of resonator 10*d* through iris 30*c*. In addition, the field of resonator 10*a* further couples to the field of resonator 10*c* through cross-coupler 34. Wall 32*a*, which does not have an iris or a cross-coupler, prevents the field of resonator 10*a* from coupling with the physically adjacent resonator 10*d* on the other side of the wall 32*a*.

One or more metal plates 42 may be positioned adjacent each resonator to affect the field of the resonator to set the center frequency of the filter. Particularly, plate 42 may be mounted on a screw 44 passing through a top surface (not shown) of the enclosure 24. The screw 44 may be rotated to vary the spacing between the plate 42 and the resonator 10 to adjust the center frequency of the resonator. A coupling loop connected to an output coupler 38 is positioned adjacent the last resonator 10*d* to couple the microwave energy out of the filter 20. Signals also may be coupled into and out of a dielectric resonator circuit by other methods, such as microstrips positioned on the bottom surface 44 of the enclosure 24 adjacent the resonators. The sizes of the resonators 10, their relative spacing, the number of resonators, the size of the cavity 22, the size of the irises 30, and the size and position of the metal plates 42 all need to be precisely controlled to set the desired center frequency of the filter, the bandwidth of the filter, and the rejection in the stop band of the filter. More specifically, the bandwidth of the filter is controlled primarily by the amount of coupling of the electric and magnetic fields between the resonators. Generally, the closer the resonators are to each other, the more coupling between them and the wider the bandwidth of the filter. On the other hand, the center frequency of the filter is controlled in large part by the size of the resonator and the size and the spacing of the metal plates 42 from the corresponding resonators 10.

In an alternative prior art cross-coupled dielectric resonator filter, coaxial cables are used to couple resonators that are separated by walls without irises and/or are not adjacent to one another. A detailed discussion of cross-coupled dielectric resonators is found in U.S. Pat. No. 5,748,058 to Scott entitled CROSS COUPLED BANDPASS FILTER, incorporated fully herein by reference.

Prior art cross-coupled dielectric resonator filters have limited frequency bandwidth performance. The maximum frequencies at which they can perform effectively are typically limited to about 55 to 60 GHz. The effective bandwidth range of prior art cross-coupled dielectric resonator filters is typically on the order of 3 to 20 MHz. In particular, the bandwidth is restricted because the coupling between resonators is limited.

Prior art resonators and the cross-coupled resonator circuits made from them have many drawbacks. For instance, as a result of the positions of the fields of the resonators, prior art resonators have limited ability to couple with other resonators (or with other microwave devices such as loop couplers and microstrips). That is why filters made from prior art resonators have limited bandwidth range. Further, prior art cross-coupled dielectric resonator circuits rely on probes or coaxial cables for cross-coupling, and filter poles may have to be laid in a zig-zag manner, which put significant constraints on filter performance. In addition, prior art cross-coupled dielectric resonator circuits such as the filter 20 shown in FIG. 2 suffer from poor quality factor, Q, due to the presence of separating walls and coupling screws between adjacent resonators. Q essentially is an efficiency rating of the system and, more particularly, is the ratio of stored energy to lost energy in the system. The fields generated by the resonators pass through all of the conductive components of the system, such as the enclosure 24, plates 42, and internal walls 32 and inherently generate currents in those conductive elements. Those currents essentially comprise energy that is lost to the system.

Furthermore, the volume and configuration of the conductive enclosure 24, substantially affects the operation of the system. The enclosure minimizes radiative loss. However, it also has a substantial effect on the center frequency of the TE mode. Accordingly, not only must the enclosure be constructed of a conductive material, but it must be very precisely machined to achieve precise coupling and the desired center frequency performance, thus adding complexity and expense to the fabrication of the system. Even with very precise machining, the design can easily be marginal and fail specification.

Furthermore, prior art resonators have poor mode separation between the desired TE mode and the undesired $H_{11}$ mode.

FIGS. 3A and 3B illustrate typical locations for the TE and $H_{11}$ modes, respectively, in a typical prior art cylindrical resonator 10. As shown, the electric field lines of the TE mode field 50 are circular, oriented parallel to the circular dimension of the resonator cylinder 12 and concentrated around the circumference of the resonator 10, with some of the field within the resonator and some of the field without the resonator. A portion of the field is outside the resonator for purposes of coupling between the resonator and other microwave devices (e.g., other resonators or input/output couplers).

The $H_{11}$ mode field 60 is orthogonal to the TE mode. The electric field lines of field 60 form circles parallel to the page in FIG. 3B and are concentrated near the surface of the cylinder 12. It is very difficult to physically separate the $H_{11}$ mode from the TE mode. Accordingly, methods for suppressing the $H_{11}$ mode have been developed in the prior art. For instance, metal strips 70 such as illustrated in FIG. 4 have been placed on the surface of the resonators to suppress the $H_{11}$ mode by causing its tangential electric field to be zero at the metal strips 70, effectively causing the suppression of the mode because its maximum field strength is located near the metal strips. In practice, while this technique for suppressing the $H_{11}$ mode is relatively effective in terms of suppressing the $H_{11}$ mode, it also typically suppresses the TE mode significantly. In theory, the effect on the TE mode should be insignificant, but experiments show that this is not the case in the real world and that this method for $H_{11}$ suppression actually significantly affects Q for the TE mode. Experiments show that this technique typically might cause losses of about half of the power of the TE mode, thus substantially reducing the Q of the resonator and the overall system in which it is employed.

Accordingly, it is an object of the present invention to provide improved cross-coupled dielectric resonator circuits.

It is another object of the present invention to provide improved cross-coupled dielectric resonator filters.

It is another object of the present invention to provide cross-coupled dielectric resonator circuits in which the $H_{11}$ mode is substantially suppressed or eliminated.

It is yet a further object of the present invention to provide cross-coupled dielectric resonator circuits that are easily tunable.

It is one more object of the present invention to provide cross-coupled dielectric resonator circuits with more effective coupling and cross-coupling than in the state of the art.

It is a further object of the present invention to provide cross-coupled dielectric resonator circuits with improved Q factors.

It is yet a further object of the present invention to provide cross-coupled dielectric resonator circuits with improved layouts.

It is one more object of the present invention to provide cross-coupled dielectric resonator filters having compact packaging.

SUMMARY OF THE INVENTION

The invention is an improved cross-coupled dielectric resonator circuit. In one form, the circuit includes dielectric resonators varying in cross-sectional area between first and second ends. The resonators are arranged relatively to each other within an enclosure in a very efficient and compact design that enhances adjustability and coupling between adjacent resonators (i.e., resonators having longitudinal axes that are closest in a substantially linear direction perpendicular to the axes) and between at least one pair of alternate resonators (i.e., resonators having longitudinal axes that are on opposite sides of the longitudinal axis of another resonator in a substantially linear direction perpendicular to the axes).

In accordance with a preferred embodiment, an adjustable conductive member is associated with a resonator positioned between a pair of alternate resonators. Adjusting the conductive members affects the cross-coupling of the field between the alternate resonators. If the conductive member is electrically coupled to the enclosure, the alternate resonators will be inductively cross-coupled. If the conductive member is electrically isolated from the enclosure, the alternate resonators with be capacitively cross-coupled.

In accordance with a preferred embodiment, a plurality of resonators having bodies that vary in cross-sectional area are arranged in an enclosure such that the longitudinal orientation of each resonator is flipped relative to its adjacent resonator or resonators. This arrangement permits positioning of the resonators within a much smaller space than possible with comparable uniform cross-sectional area resonators. This particular arrangement enhances coupling, cross-coupling, and adjustability and thus expands the frequency and bandwidth range achievable by such a filter.

The varying cross-sectional area dielectric resonators physically displace the $H_{11}$ mode from the TE mode in the longitudinal direction. Particularly, the TE mode tends to concentrate in the base (the wider portion) while the $H_{11}$ mode tends to concentrate at the top (the narrower portion). By removing the top so as to eliminate the portion where the $H_{11}$ mode field exists, yet keep the portion where the TE mode exists, the $H_{11}$ mode can be virtually eliminated while having little effect on the magnitude of the TE mode. The angle of the side wall (i.e., its taper), can be controlled to adjust the physical separation of the TE and $H_{11}$ modes. The radius of a longitudinal hole through the resonator between the first and second ends can be adjusted either in steps or entirely to optimize insertion loss, volume, spurious response and other properties. The improved frequency separation between the TE mode and $H_{11}$ mode combined with the physical separation thereof enables tuning of the center frequency of the TE mode with a substantial reduction or even entire elimination of any effect of the tuning on the $H_{11}$ mode. This design also provides better quality factor for the TE mode, generally up to 10% better because more of the TE field is outside of the resonator due to the taper in the longitudinal direction. It also enhances coupling to other microwave devices such as microstrips, conductive loops, and other resonators, enabling the construction of wider bandwidth filters.

BRIEF DESCRIPTION OF THE DRAWINGS

In the drawings, the same reference numerals are used to indicate the same elements.

DETAILED DESCRIPTION OF THE INVENTION

Figure 5A:
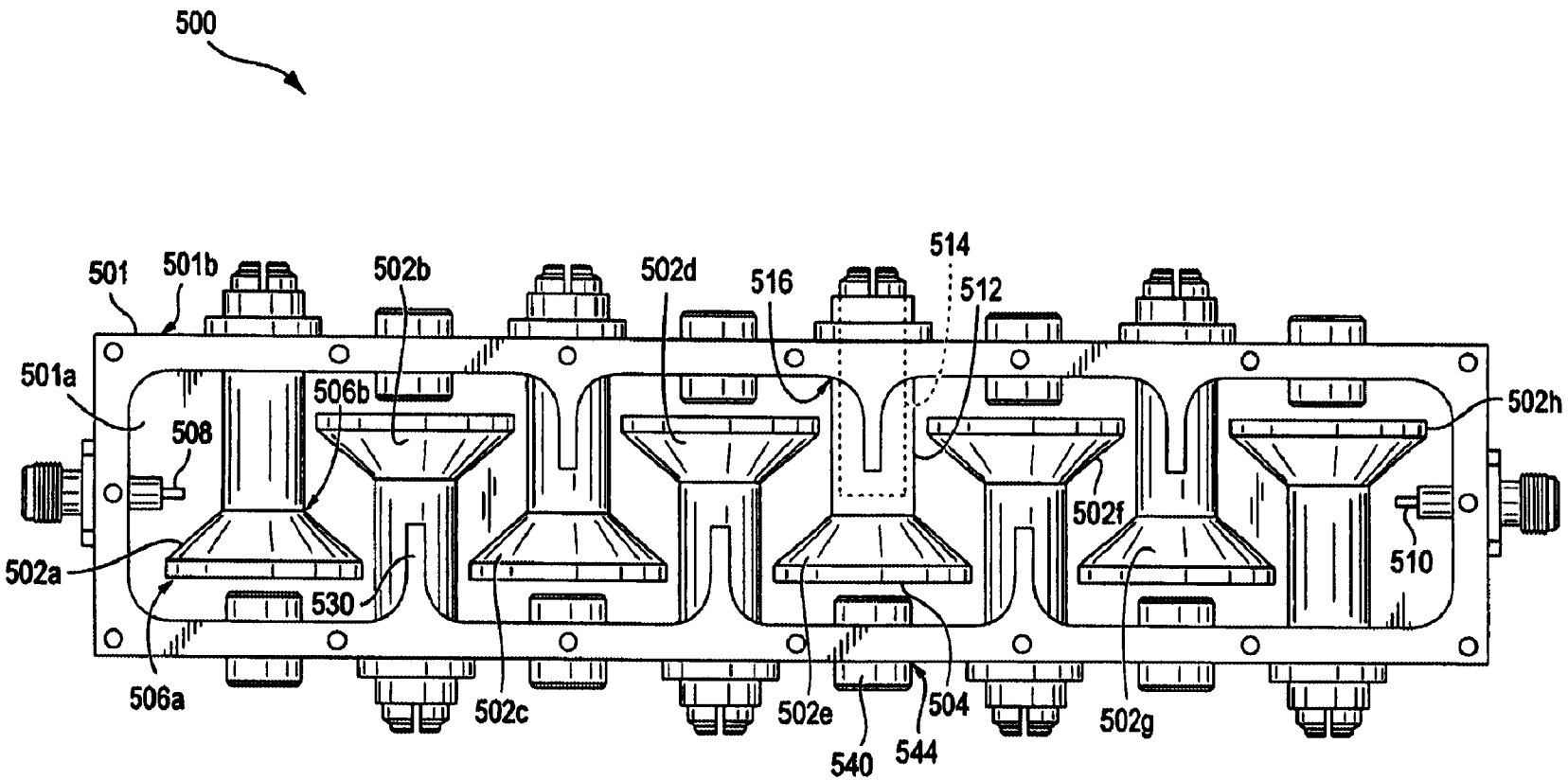
FIG. 5A is a top view of a cross-coupled dielectric resonator filter in accordance with the present invention.
Figure 5B:
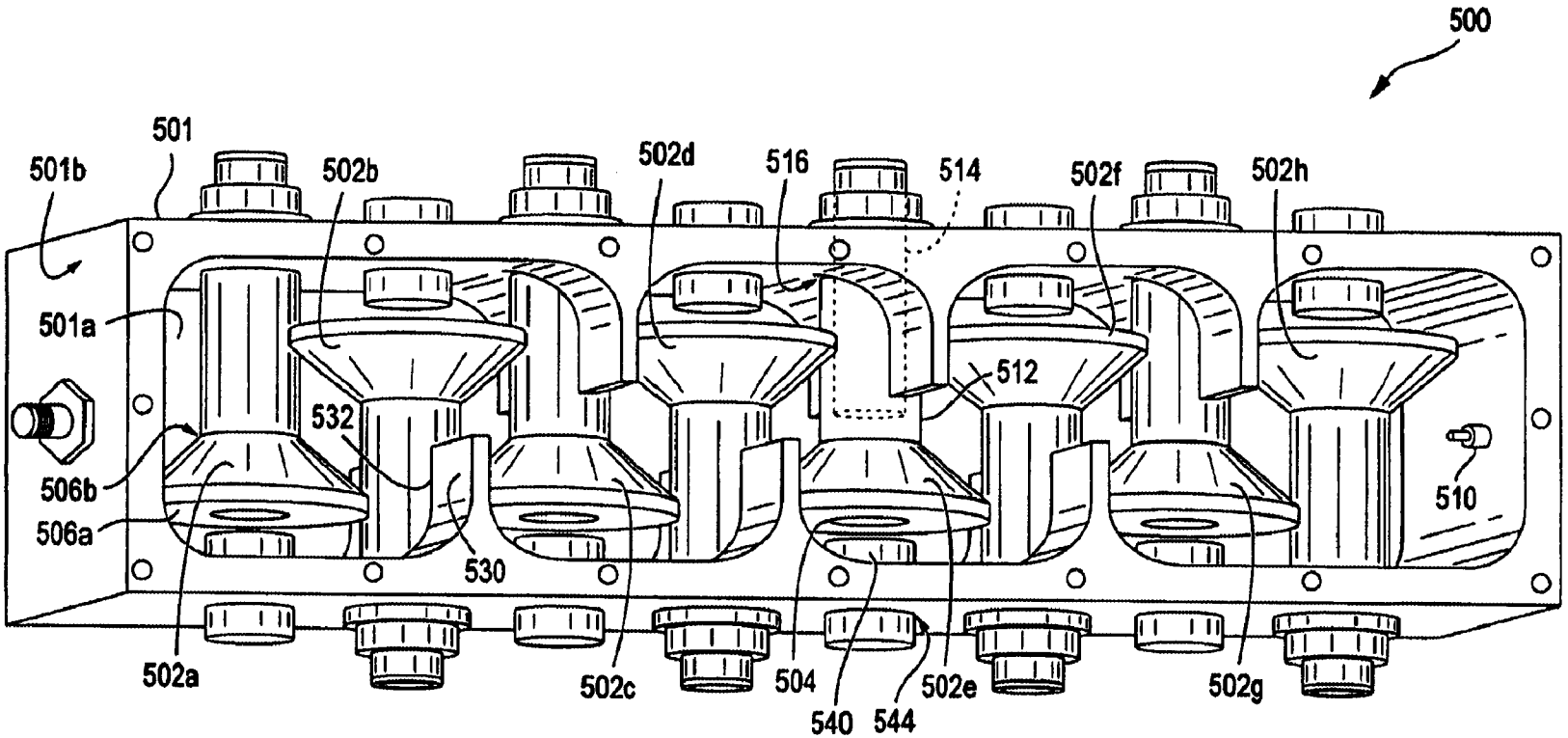
FIG. 5B is a perspective view of the filter of FIG. 5A.

FIGS. 5A and 5B depict a top view and a perspective view, respectively, of an embodiment of a cross-coupled dielectric resonator filter 500 in accordance with the present invention. The filter 500 comprises an enclosure 501 having a bottom 501*a*, side walls 501*b*, and a top wall (shown as transparent for purposes of illustrating the internal components) to form a complete enclosure. Resonators 502 are positioned within the enclosure 501 for processing a field received within the cavity of the filter 500. Although a filter is depicted and described, the present invention is applicable to other types of dielectric resonator circuits including by way of example, but not limited thereto, oscillators, triplexers, antennas, etc.

A field may be coupled into the filter 500 through any reasonable means known in the prior art or discovered in the future, including by forming microstrips on a surface of the enclosure or by use of coupling loops as described in the background section of this specification. In one embodiment, a field supplied from a coaxial cable is coupled to an input coupling loop 508 positioned near the first resonator 502*a* and passed at an output coupling loop 510 positioned near the last resonator 502*h*.

The plurality of resonators 502 are arranged within the enclosure in any configuration suitable to achieve the performance goals of the filter. In the illustrated embodiment, the resonators 502 are positioned such that their longitudinal axes are parallel to each other, but not collinear, and generally reside in one of two planes perpendicular to their longitudinal axes. For example, resonators 502*a, c, e, g* reside in one plane and resonators 502*b, d, f, h* reside in another plane. As will be described in detail below, the resonators 502 may be moved along their longitudinal axes for tuning purposes (i.e., to adjusting the bandwidth of the filter) and therefore may not reside exactly in the same plane, however, the movement is typically small and the resonators will remain in the vicinity of their respective planes. The resonators 502 are positioned to permit electromagnetic field coupling between adjacent resonators, i.e., resonators having longitudinal axes that are closest in a substantially linear direction perpendicular to their longitudinal axes (e.g., resonators 502*a, b*). The resonators 502 are further positioned to permit electromagnetic field cross-coupling between at least one pair of alternate resonators, i.e., resonators having longitudinal axes that are on opposite sides of the longitudinal axis of another resonator in a substantially linear direction perpendicular to their longitudinal axes (e.g., resonators 502*a, c*). In at least one preferred embodiment, the resonators have a dielectric constant of at least 45 and are formed of barium tetratitanate.

In the illustrated embodiment, the resonators 502 vary in cross-sectional area in a longitudinal direction between a first end and a second end, such as between a base 506*a* and a top 506*b*. The illustrated resonators each contain a longitudinal through hole, such as through hole 504, the radius of which can be selected to optimize insertion loss, volume, spurius response and other properties. Further, the radius of the longitudinal through hole can be variable, such as comprising one or more steps. A detailed discussion of the characteristics of such resonators is included below and additional information regarding these resonators can be found in the related, commonly assigned, co-pending U.S. provisional patent application Ser. No. 60/411,337 entitled DIELECTRIC RESONATORS AND CIRCUITS MADE THEREFROM filed on Sept. 17, 2002 and the related, commonly assigned, co-pending U.S. non-provisional patent application Ser. No. 10/268,415 entitled DIELECTRIC RESONATORS AND CIRCUITS MADE THEREFROM filed on the same date as the present application, both of which are incorporated fully herein by reference.

Preferably, each resonator 502 is longitudinally inverted relative to its adjacent resonator or resonators. Thus, resonator 502*a* is right side up, resonator 502*b* is upside down, resonator 502*c* is right side up, etc. This arrangement permits the resonators to be placed in closer proximity to one another than in the prior art, thus smaller enclosures 501 are obtainable over the prior art.

Each resonator 502 is coupled to the enclosure 501 via a mounting member, such as mounting member 512. In the illustrated embodiment, except for the first and last resonators 502*a, h*, the mounting member is at least partially positioned between the resonators on either side of the resonator to which the mounting member is attached (i.e., between alternate resonators). The mounting member 512 is parallel to the longitudinal axis of the resonator 502*e* and, preferably, is coaxial thereto. The mounting member 512 in the illustrated embodiment is adjustable to position the resonator 502*e* for tuning and, preferably, is non-conductive to prevent interference with the coupling between the adjacent and alternate resonators.

In the embodiment illustrated in FIG. 5A, a conductive member, such as conductive member 514, is associated with the mounting member of at least one resonator, e.g., mounting member 512, and, preferably, is coaxial thereto, i.e., one is inside the other. As will be described in detail below, through movement of the conductive member 514, cross-coupling between the alternative resonators separated by the mounting member is affected. By way of example, if the mounting member and the conductive member are associated with resonator 502*e*, moving the mounting member to move resonator 502*e* will tune that resonator 502*e*, while moving the conductive member will affect the cross-coupling of the field between the non-adjacent resonators 502*d, f*.

In the illustrated embodiment, the displacement of the resonators relative to each other is fixed in the transverse direction upon assembly, but is adjustable in the longitudinal direction after assembly. Particularly, in one embodiment, the mounting members are threaded mounting cylinders that are screwed into threaded holes, such as threaded hole 516 in the side wall 501*b* of the enclosure. The resonators 502 also may be adjustably mounted on the mounting cylinder. Particularly, the through holes in the resonators 502 may also be threaded to mate with the threads of the mounting cylinder. Accordingly, by rotating the mounting cylinder relative to the holes in the enclosure 501 and/or the through holes in the resonators 502, the longitudinal positions of the resonators relative to each other and to the enclosure 501 can be adjusted easily.

In a preferred embodiment, however, the resonators are fixedly mounted to the mounting cylinders and the mounting cylinders are rotatable only within the holes 516 in the enclosure. If the holes in the enclosure are through holes, the resonator spacing, and thus the bandwidth of the filter, can be adjusted without even opening the enclosure 501 simply by rotating the mounting cylinders that protrude from the enclosure.

In the embodiment illustrated in FIGS. 5A and 5B, the mounting cylinder 512 is a hollow cylinder further having internal threads. The mounting cylinder is screwed into a threaded hole in the side wall 501*b* of the enclosure. In this embodiment, the conductive member is a conductive cylinder having external threads for mating with the internal threads of the hollow mounting cylinder. By turning the hollow mounting cylinder, the position of the resonator to which it is attached is adjusted, thereby tuning that resonator. By turning the conductive cylinder within the hollow mounting cylinder, the position of the conductive cylinder is altered such that more or less of the conductive cylinder is inserted between the resonators on either side of the conductive cylinder, thereby affecting the cross-coupling between the alternate resonators separated by the conductive cylinder. The mounting member and the conductive member can be adjusted individually of each other as well as jointly. In this embodiment, since the conductive member is isolated from the enclosure (which is grounded) by the mounting member, generated charges in the conductive member do not go to ground. Instead, the charges are stored in the conductive member to produce capacitive cross-coupling between the alternate resonators, which, as is well known in the art, will improve attenuation at the upper frequency of the filter's pass band.

Figure 6A:
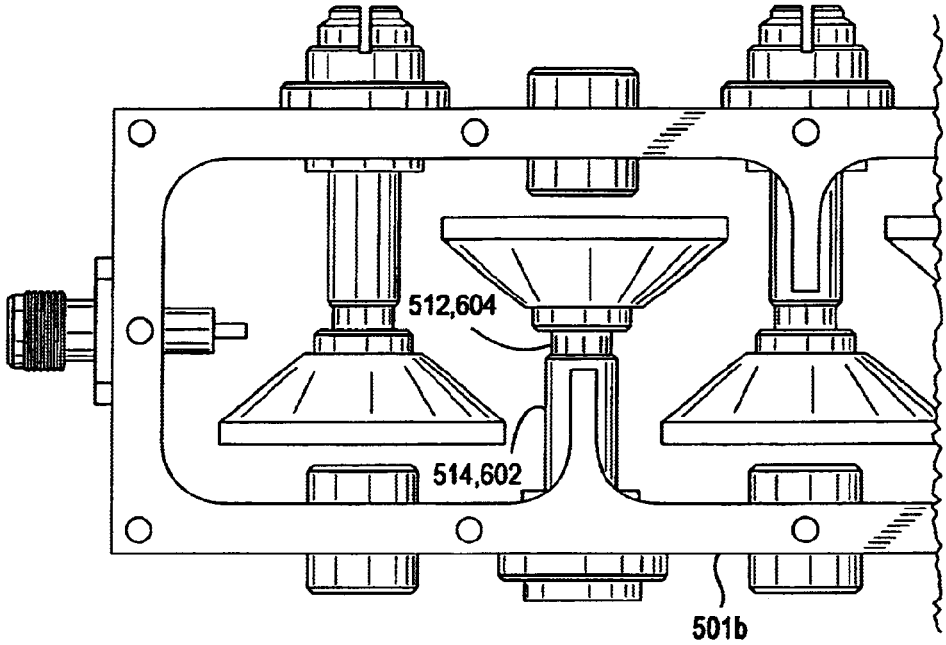
FIG. 6A is a partial top view of a filter illustrating an alternative embodiment for a mounting member and a conductive member for use in the filter of FIGS. 5A and 5B.

An alternative mounting member and conductive member arrangement is depicted in FIG. 6A, which is a partial view of a filter similar to the filter 500 of FIGS. 5A and 5B, except for the mounting member and the conductive member. The conductive member 514 in this embodiment is a hollow conductive cylinder 602 external to the mounting member having internal and external threads. The hollow conductive cylinder 602 is screwed into a threaded hole in the side wall

501*b* of the enclosure. In this embodiment, the mounting member 512 is a mounting cylinder 604 having external threads for mating with the internal threads of the hollow conductive cylinder 602. By turning the mounting cylinder 604 within the hollow conductive cylinder, the position of the resonator to which it is attached is adjusted, thereby tuning that resonator. By turning the hollow conductive cylinder 602, the position of the conductive cylinder is altered such that coupling between alternate resonators separated by the hollow conductive cylinder 602 is affected. As in the previous embodiment, the mounting member and the conductive member can be adjusted individually of each other as well as jointly. In this embodiment, since the conductive element is in contact with the enclosure, which is grounded, generated charges are grounded. Therefore, inductive cross-coupling is provided between the alternate resonators, which, as is well known in the art, will improve attenuation at the lower frequency of the filter's pass band. In one particular embodiment, the mounting cylinder is produced entirely from non-conductive material. In alternative embodiments, the mounting cylinder may have a metal core to provide rigidity.

Figure 6B:
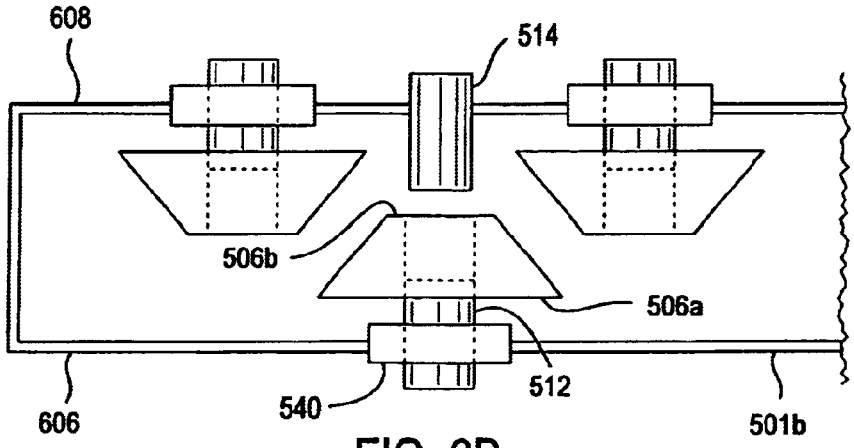
FIG. 6B is a partial top view of a filter illustrating an alternative embodiment for a mounting member and a conductive member for use in the filter of FIGS. 5A and 5B.

An alternative mounting member and conductive member arrangement is depicted in FIG. 6B. In accordance with this embodiment, the mounting member 512 extends from a first side wall, e.g., side wall 606, of the enclosure side wall 501*b* and the conductive member 514 extends from a second side wall opposite the first side wall 606, e.g., side wall 608. In the illustrated embodiment, the mounting member 512 is coupled to the base 506*a* of the resonator, rather than the top 506*b* as in the embodiments illustrated in FIGS. 5A, 5B, and 6A. In the illustrated embodiment, the mounting member extends through a tuning plate 540 (described in detail below). Preferably, the conductive member 514 is an externally threaded cylinder that is screwed into a threaded hole in the side wall 501*b* of the enclosure. The mounting member 512 is an externally threaded cylinder that is screwed into a threaded hole in the tuning plate 540, if present, otherwise, it is screwed into a threaded hole in the side wall 501*b*. By turning the mounting member 512, the position of the resonator to which it is attached is adjusted and by turning the conductive cylinder 514, the position of the conductive cylinder is altered such that cross-coupling between alternate resonators is affected. As in the embodiment depicted in FIG. 6A, since the conductive member is in contact with the enclosure, inductive cross-coupling occurs between the alternate resonators. It is contemplated that a non-conductive ring may be used to electrically isolate the conductive element from the enclosure, thereby, providing capacitive cross-coupling in the embodiments depicted in FIGS. 6A and 6B.

Referring back to FIGS. 5A and 5B, walls, such as partial wall 530, may be used to affect coupling between alternate resonators in the illustrated embodiment. As illustrated, except for the first and last resonators 502*a, h*, partial walls are associated with each of the resonators 502*b–g* and, preferably, are not positioned between adjacent resonators. The partial walls are constructed such that they contain a gap 532 to allow cross-coupling between alternate resonators and movement of the conductive member and/or the mounting member. Since walls exist between only alternate resonators, e.g., resonators 502*a, c*, and not between adjacent resonators, e.g., 502*a, b*, the Q factor of the filter 500 is influenced favorably.

Figure 1:
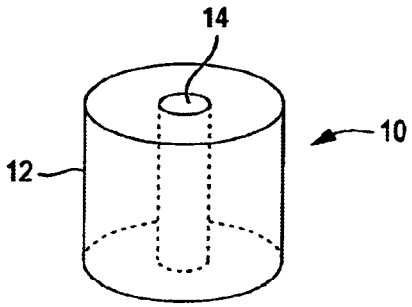
FIG. 1 PRIOR ART
FIG. 1 is a perspective view of a cylindrical dielectric resonator of the prior art.
Figure 4:
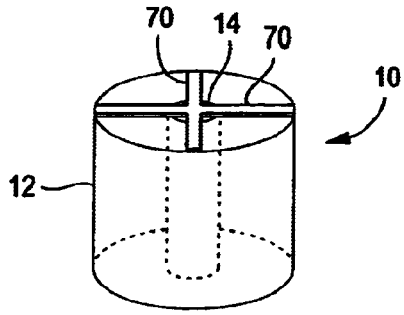
FIG. 4 PRIOR ART
FIG. 4 is a perspective view of a dielectric resonator of the prior art similar to FIG. 1 except further including metal strips for suppressing the $H_{11}$ mode in the resonator.
Figure 2:
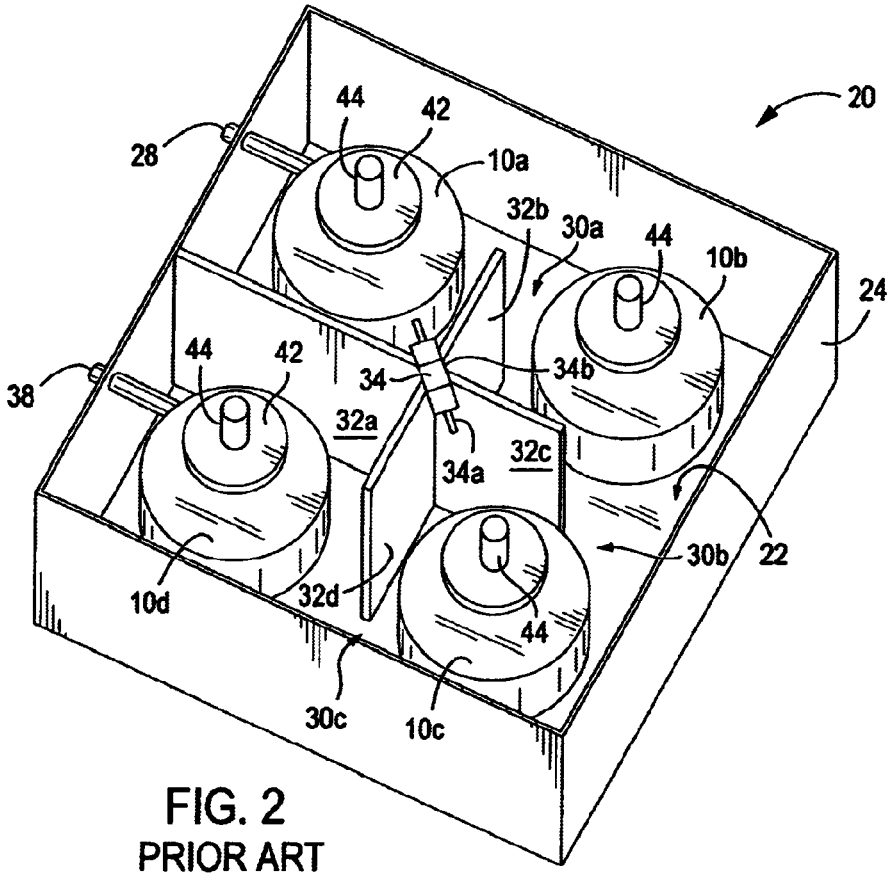
FIG. 2 PRIOR ART
FIG. 2 is a perspective view of an exemplary cross-coupled dielectric resonator filter of the prior art.
Figure 3A:
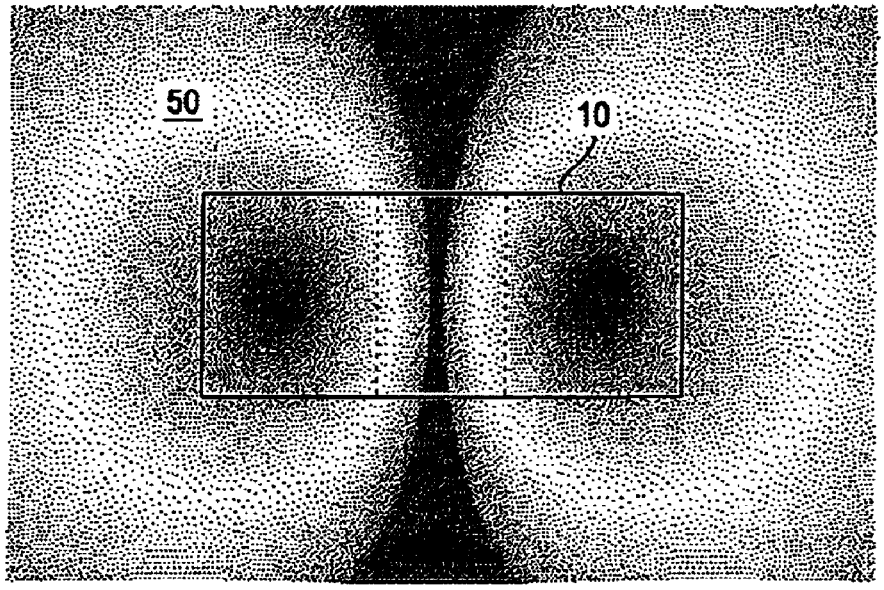
FIG. 3A PRIOR ART
FIG. 3A is a cross-sectional diagram of a cylindrical resonator of the prior art illustrating the location of the TE mode electric field.
Figure 3B:
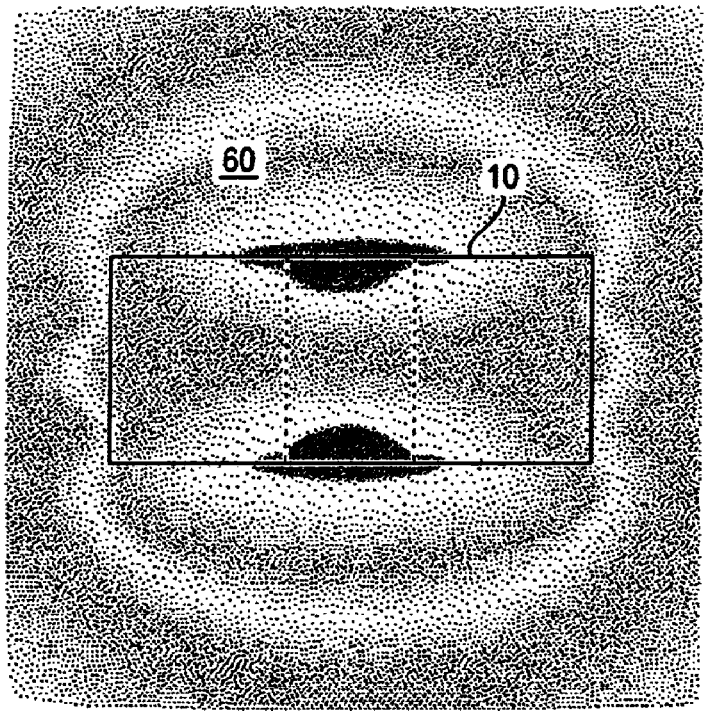
FIG. 3B PRIOR ART
FIG. 3B is a cross-sectional diagram of a cylindrical resonator of the prior art illustrating the location of the $H_{11}$ mode electric field.

The filter 500 further includes circular conductive tuning plates, such as tuning plate 540, adjustably mounted on the enclosure 501 so that they can be moved longitudinally relative to the bases of the resonators 502. As in the prior art, these tuning plates are used to adjust the center frequency of the TE mode of the resonators, and thus the filter. These plates may be threaded cylinders having a uniform diameter that pass through holes 544 in the enclosure 501 to provide adjustability after assembly. In an alternative embodiment, the plates may be adjustably mounted to the enclosure with a threaded cylinder having a smaller diameter than the plate similar to the plates 42 discussed above in connection with FIG. 2.

Because of the mode separation, as described in detail below, between the TE and the $H_{11}$ modes and the physical separation of the TE and $H_{11}$ modes inherent to resonators that vary in cross-sectional area between a first end and a second end, in dielectric resonator circuits employing these resonators, it is possible to tune the center frequency of the TE mode with very little effect on the $H_{11}$ mode. Any effect of TE mode center frequency tuning on the $H_{11}$ mode can be even further reduced or eliminated by making the tuning plate of a small radius, such as slightly larger than the radius of the longitudinal through hole of the resonator. By making the tuning plate small, the plate can primarily remain outside of the $H_{11}$ mode field yet still extend significantly into stronger portions of the TE field and, thus, still significantly affect it. This is especially advantageous in the cross-coupled dielectric resonator circuit of the present invention where the resonators are positioned in close proximity to one another and cross-coupling is to occur between alternate resonators. In one preferred embodiment of the invention, the tuning plate has a radius smaller than the base of the resonator but larger than the radius of a through hole extending longitudinally through the resonator. In a more preferred embodiment, the tuning plate has a radius of between about 120% and about 150% the radius of the through hole.

The threaded cylinders associated with the resonators, tuning plates, and conductive members can be coupled to electronically controlled mechanical rotating means to remotely tune the filter. For instance, the cylinders can be remotely controlled to tune the filter using local stepper motors and digital signal processors (DSP) that receive instructions via wired or wireless communication systems. The operating parameters of the filter may be monitored by additional (DSPs) and even sent via the wired or wireless communication system to a remote location to affirm correct tuning, thus forming a truly remote-controlled servo filter.

The present invention also can use conventional, cylindrical dielectric resonators. For instance, the varying cross-sectional area resonators 502*a–h* in FIGS. 5A and 5B can be replaced with conventional cylindrical resonators. Although performance in almost every respect, including tuning, would be inferior to the filter 500 of FIG. 5A and 5B, intended goals of the invention would be achieved. Specifically, the arrangement allows for direct cross-coupling between alternate resonators, e.g., without the use of probes or coaxial cables, and easily adjustable cross-coupling between alternate resonators. Accordingly, the invention is useful in connection with conventional dielectric resonators also.

Since the design of the cross coupled dielectric resonator filter of the present invention inherently provides for wide flexibility of coupling between adjacent and alternate, non-adjacent resonators, a circuit can be easily designed in which the enclosure can be fabricated using low-cost molding or casting processes, with lower cost materials and without the need for precision or other expensive milling operations, thus substantially reducing manufacturing costs. A filter constructed in accordance with the principals of the present invention such as illustrated in FIGS. 5A and 5B should be able to provide bandwidth selectivity from below 3 MHz to over 120 MHz at a center frequency of greater than 1 GHz depending on the positioning of the resonators relative to each other.

Figure 7A:
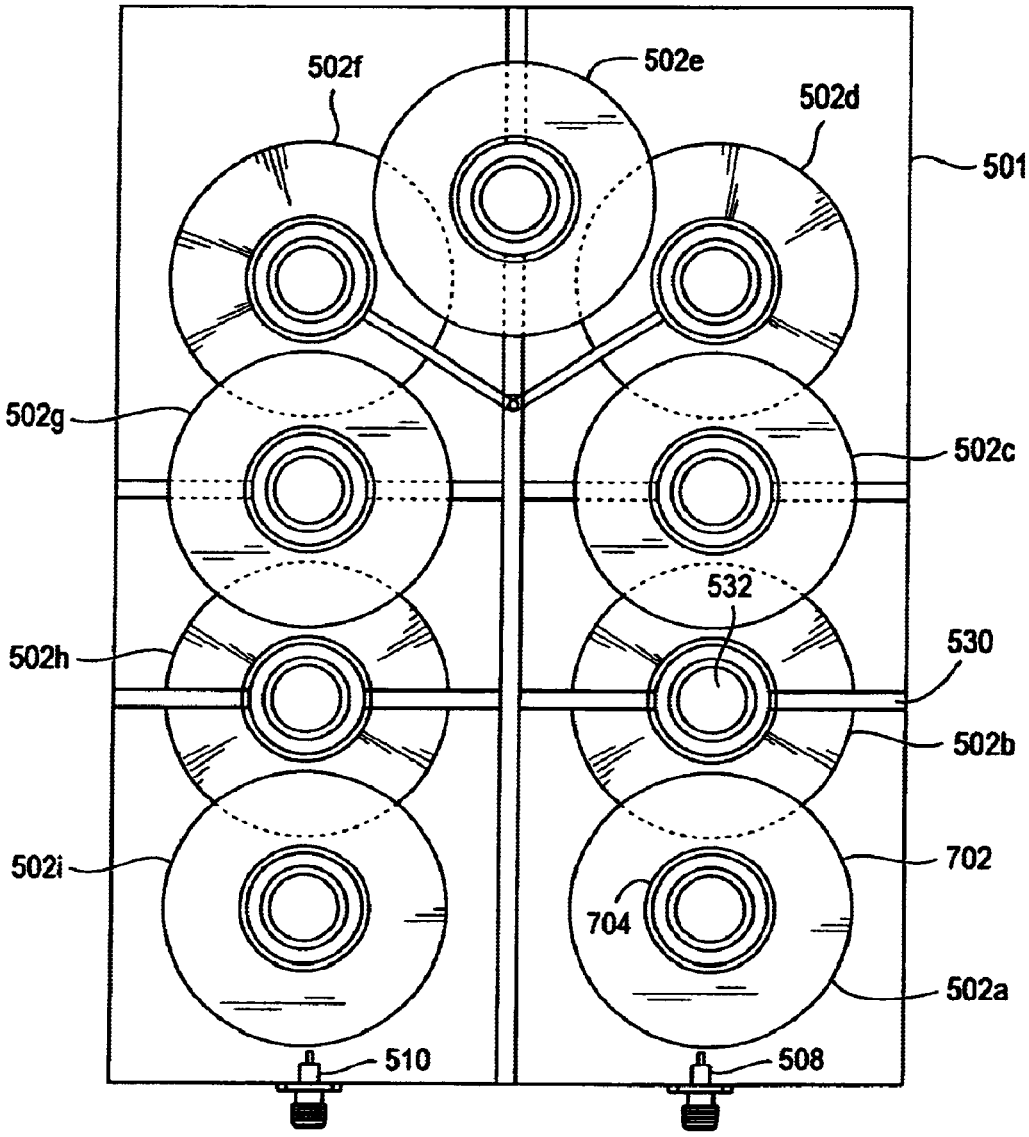
FIG. 7A is a side plan view of a dielectric resonator layout for 9 dielectric resonators in accordance with the present invention.

FIG. 7A depicts a side plan view of an alternative embodiment of the present invention. The layout depicted in FIG. 7A is for a cross-coupled resonator filter that is folded back on itself (i.e., a first resonator 502*a* is coupled to an input loop 508 and a last resonator 502*i* is coupled to an output loop 510 near the input loop), but in all other respects is essentially identical to the filter of FIGS. 5A and 5B, with like elements being identically numbered. In the illustrated embodiment, nine resonators 502 are depicted within an enclosure 501. As described above in reference to FIGS. 5A and 5B, the resonators are positioned such that coupling occurs between adjacent resonators, e.g., resonators 502*a* and 502*b*, and cross-coupling occurs between at least one pair of alternate resonators, e.g., resonators 502*a* and 502*c*.

The resonators are positioned within the enclosure 501 such that their longitudinal axes are parallel to each other, but not collinear. As described above, the resonators preferably vary in cross-sectional area, with the base of the resonator represented by a large circle, such as outer circle 702 associated with resonator 502*a*, and the top of the resonator represented by a smaller circle, such as inner circle 704 associated with resonator 502*a*. The resonators are preferably inverted longitudinally to their adjacent resonators to permit the resonators to be placed in close proximity. Partial walls 530 containing a gap 532 are associated with at least one of the resonators, e.g., resonator 502*b*. Mounting members and conductive members, such as those described in detail above, are used to position the resonators and control cross-coupling between alternate resonators, respectively.

In view of the above detailed description of filter 500, the operation of a filter in accordance with the layout depicted in FIG. 7A will be readily apparent to those skilled in the art. Hence, further detail is unnecessary.

Figure 7B:
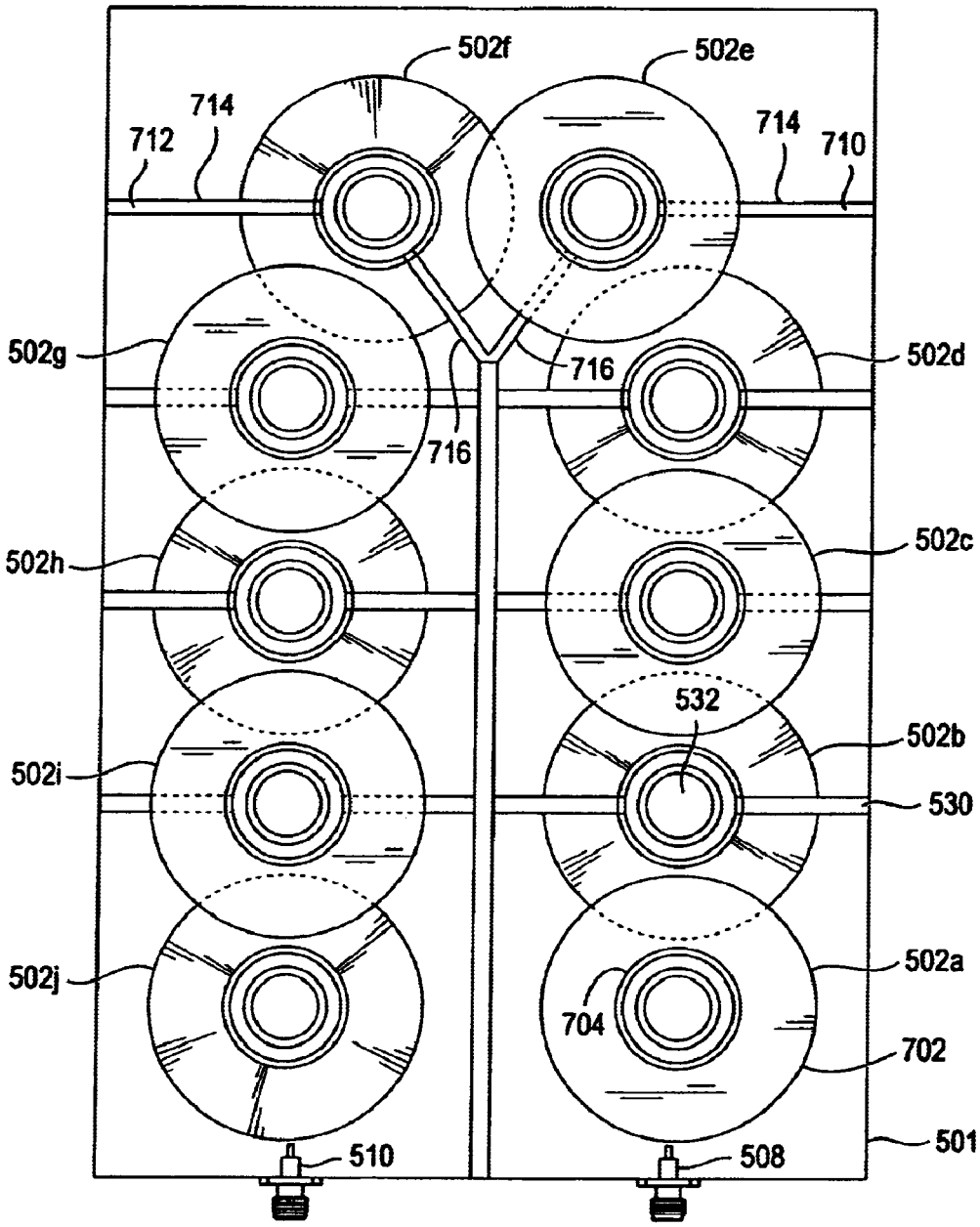
FIG. 7B is a side plan view of a dielectric resonator layout for 10 dielectric resonators in accordance with the present invention.

FIG. 7B depicts a side plan view of another alternative embodiment of the present invention. The layout depicted in FIG. 7B is for a cross-coupled resonator filter having ten dielectric resonators 502, but in all other respects is essentially identical to the filter of FIG. 7A, with like elements being identically numbered. In the embodiment illustrated in FIG. 7B, a partial wall 710 is positioned between dielectric resonators 502*d, f* and another partial wall 712 is positioned between dielectric resonators 502*e, g*. These partial walls 710, 712 each have a first portion 714 substantially perpendicular to lines (not shown) passing through the longitudinal axes of the first four dielectric resonators 502*a–d* and through the longitudinal axes of the last four dielectric resonators 502*g–j*. A second portion 716 of these partial walls forms an angle of approximately 45 degrees with respect to the first portion 714.

Figure 7C:
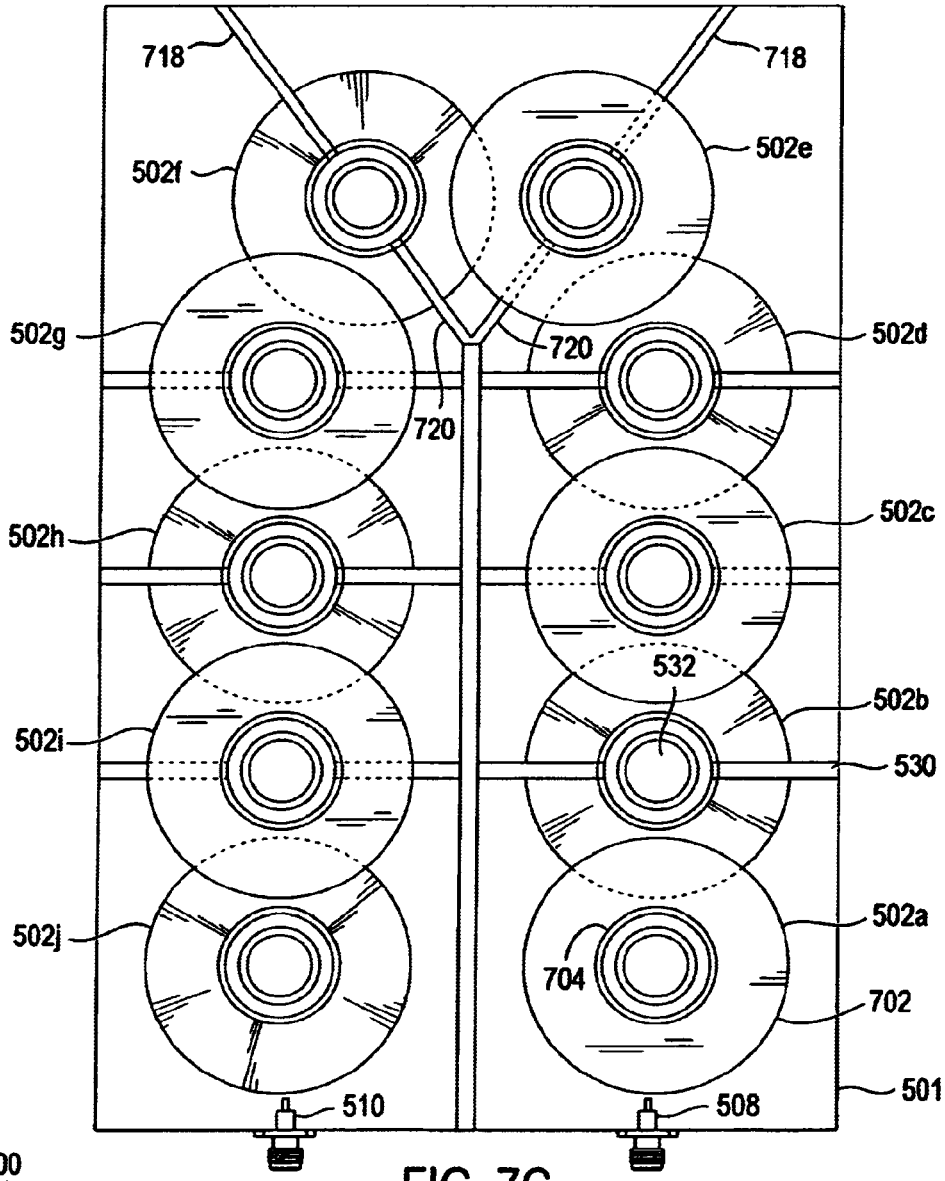
FIG. 7C is a side plan view of an alternative dielectric resonator layout for 10 dielectric resonators in accordance with the present invention.

FIG. 7C depicts a side plan view of an alternative embodiment of the present invention. The layout depicted in FIG. 7C is for an alternative cross-coupled resonator filter having ten dielectric resonators, which is essentially identical to the cross-coupled resonator filter of FIG. 7B with like elements being identically numbered. The dielectric resonator filters of FIGS. 7B and 7C differ with respect to the layout of the partial walls 710 and 712, which affects the magnetic coupling between the resonators separated by these walls. The partial walls in the embodiment illustrated in FIG. 7C are configured such that a first portion 718 of each of these walls is in the same plane as a second portion 720 of each of these walls. The first and second portions 718, 720 of these walls have an angle of approximately 45 degrees with respect to lines (not shown) passing through the longitudinal axes of the first four dielectric resonators 502*a–d* and through the longitudinal axes of the last four dielectric resonators 502*g–j*.

Dielectric Resonator Details

Figure 8A:
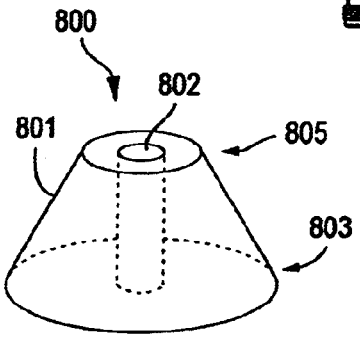
FIGS. 8A, 8B, and 8C depict resonators for use in the cross-coupled dielectric resonator circuits of the present invention.
Figure 8B:
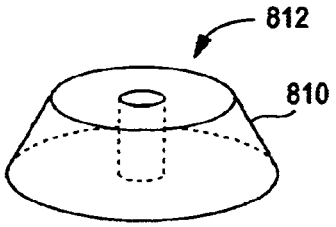
Figure 8C:
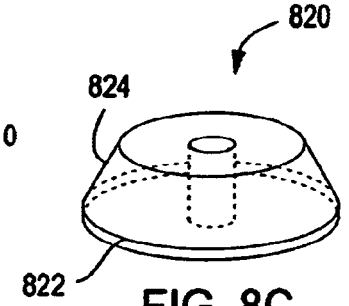

FIGS. 8A, 8B, and 8C are perspective views of some suitable dielectric resonators which may be employed in the cross-coupled dielectric resonator filter described above. Detailed information for the illustrated resonators will now be provided. Referring to FIG. 8A, a resonator 800 is formed in the shape of a truncated cone 801 with a central longitudinal through hole 802. The conical shape physically separates the TE mode field from the $H_{11}$ mode field. As in the prior art, the primary purpose of the through hole is to suppress the Transverse Magnetic (TM) mode, which is another dangerous spurious mode. The hole 802 helps improve separation between the TM mode and the fundamental TE mode, which are closer to each other in this type of resonator than in a cylindrical resonator.

Figure 9A:
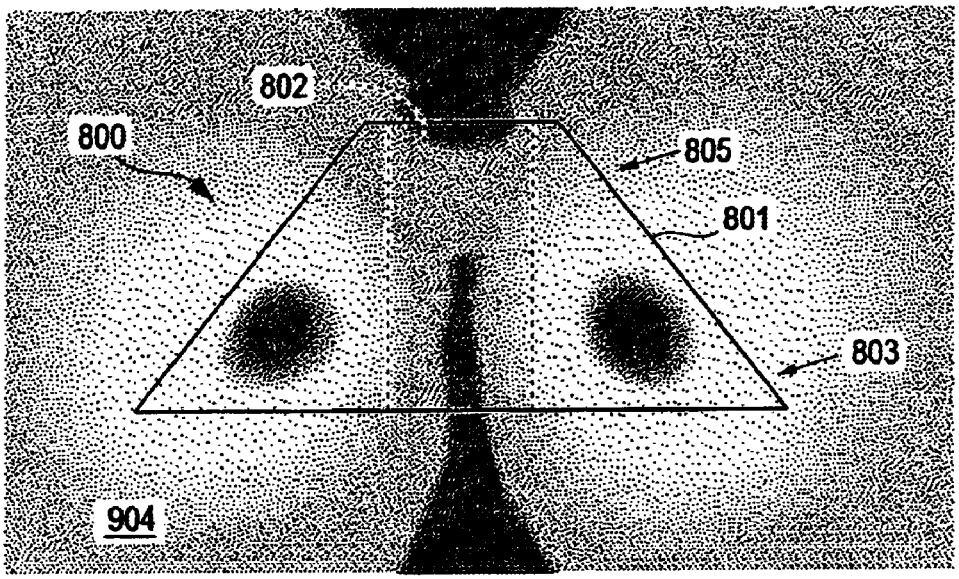
FIG. 9A is a cross-sectional view of a varying cross-sectional area dielectric resonator illustrating the position of the TE mode electric field.
Figure 9B:
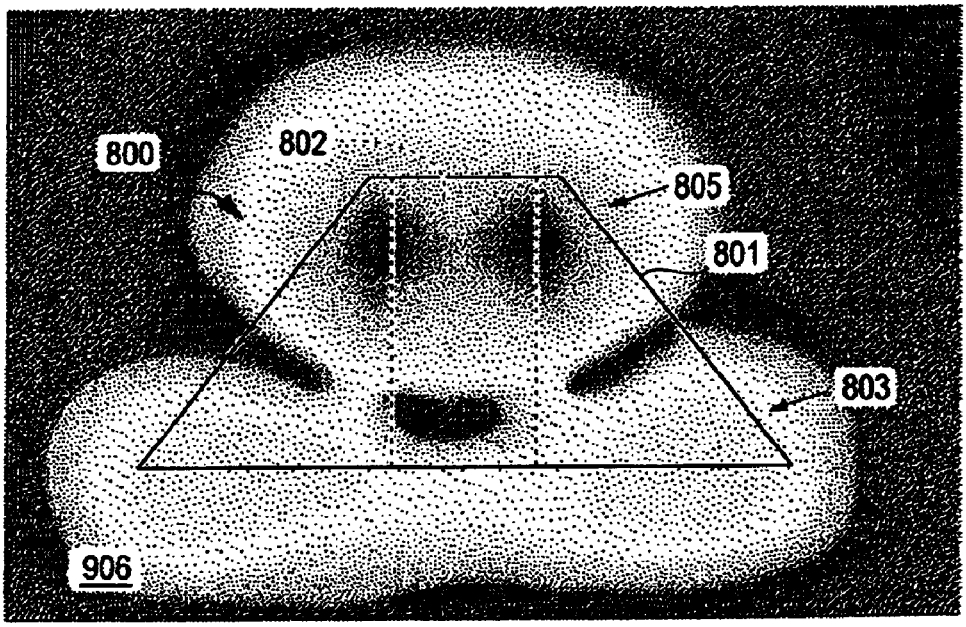
FIG. 9B is a cross-sectional view of a varying cross-sectional area dielectric resonator illustrating the position of the $H_{11}$ mode electric field.

Referring to FIGS. 9A and 9B, the TE mode electric field 904 (FIG. 9A) tends to concentrate in the base (wide portion) 803 of the resonator because of the transversal components of the electric field while the $H_{11}$ mode electric field 906 (FIG. 9B) tends to concentrate at the top (narrow portion) 805 of the resonator because of the vertical components of the electric field. The longitudinal displacement of these two modes improves performance of the resonator (or circuit employing such a resonator) because the resonators can be positioned adjacent other microwave devices (such as other resonators, microstrips, tuning plates, and input/output loops) so that their TE mode electric fields are close to each other while their $H_{11}$ mode electric fields are further apart from each other. Accordingly, the $H_{11}$ mode would not couple to the adjacent microwave device nearly as much as when the TE mode and the $H_{11}$ mode are closer to each other.

Referring to FIG. 8B, another dielectric resonator is depicted in which the body 810 of the resonator 812 is even further truncated. Particularly, relative to the exemplary resonator illustrated in FIG. 8A, one may consider the resonator of FIG. 8B to have its top removed. More particularly, the portion of the resonator in which the $H_{11}$ mode field was concentrated in the FIG. 8A embodiment is eliminated in the FIG. 8B embodiment. Accordingly, not only is the $H_{11}$ mode physically separated from the TE mode, but it is substantially attenuated to the point where it is almost non-existent relative to the magnitude of the TE mode field. Hence, in contrast to the prior art, the problematic $H_{11}$ interference mode is substantially eliminated with virtually no incumbent attenuation of the TE mode.

FIG. 8C shows another embodiment of a resonator 820 similar to those used in the illustrated embodiments depicted in FIGS. 8A and 8B. In this embodiment, the radially outermost portion of the base 822 of the resonator body 824 is trimmed off so that the bottom of the resonator has a rectangular profile rather than a isosceles trapezoidal profile. The resonator can be so modified without affecting the TE mode because only a small portion, if any, of the TE field mode is concentrated in the lower, outermost corner of the resonator (see FIG. 9A).

The use of these types of resonators is particularly well suited for use in the cross-coupled dielectric resonator filters of FIGS. 5A, 5B, 6, and 7. The conical shape permits adjacent resonators to be positioned closer together when inverted to reduce the size of the filter. In addition, the conical shape facilitates coupling between resonators since the bases can be positioned relatively close together. For instance, the bases of alternate resonators can be positioned so close together that they overlap the resonator between them in the longitudinal direction and how close they may be positioned is limited only by the mounting member and/or conductive member associate with the resonator between them. Also, as described above, the desirable TE mode electric field is retained while attenuating the undesirable $H_{11}$ mode electric field, thereby providing even greater flexibility in the positioning of the resonators. In addition, the position of the TE mode field of the resonator places more of the field at and beyond the circumference of the resonator so that the fields of adjacent resonators can be bought even closer.

In conical resonators, the area of the dielectric material parallel to the field lines of the TE mode varies monotonically in the direction perpendicular to the field lines of the TE mode. Stated in less scientific terms, the amount of dielectric material in the resonator assembly decreases as a mathematical function of height. For instance, in the right conical resonator illustrated in FIG. 8A, the area of dielectric material decreases as a function of height in accordance with the formula $$A=\Pi(b-h/\tan(\alpha))^2$$

where A=horizontal cross-sectional area b=radius at the base of the cone h=selected height α=angle of the side wall of the cone to the base of the cone.

In a stepped cylindrical embodiment, the area is constant over portions of the height, but decreases in discrete steps. In the stepped conical embodiment, the area of the dielectric material decreases with height according to the formula above (with slight modifications that would be readily apparent to those of skill in geometry to account for the discrete steps), but also has one or more discrete steps. In the conical embodiment illustrated by FIG. 8C in which the bottommost, outermost portion is cut off, the area is constant over a small portion of the height at the bottom of the resonator and then decreases in accordance with the formula above (with a slight modification that would be readily apparent to those of skill in geometry to account for the constant area at the bottommost portion of the resonator).

Having thus described a few particular embodiments of the invention, various alterations, modifications, and improvements will readily occur to those skilled in the art. For example, the mounting members may mount the resonators in a fixed position with tuning being fixed upon assembly or adjusted through the use of tuning plates and/or conductive members. Such alterations, modifications and improvements as are made obvious by this disclosure are intended to be part of this description though not expressly stated herein, and are intended to be within the spirit and scope of the invention. Accordingly, the foregoing description is by way of example only, and not limiting. The invention is limited only as defined in the following claims and equivalents thereto.

We claim:

1. A dielectric resonator circuit comprising:

a plurality of resonators, each comprising a body formed of a dielectric material, said body having a first end having a first area and a second end having a second area smaller than said first area, said body varying in cross-sectional area between said first and second ends;

wherein said plurality of resonators are positioned relative to each other such that a field generated in each resonator couples to an adjacent resonator; and wherein each of a first and second of said plurality of resonators are adjacent to a third of said plurality of resonators, wherein said first and second resonators are alternate resonators positioned such that a field in one of said first and second resonators cross-couples directly to the other of said first and second resonators;

wherein the ends of each resonator are inverted relative to the ends of adjacent resonators to which its field couples.

2. The circuit of claim 1, wherein said first, second, and third resonators have a conical shape.

3. The circuit of claim 1, wherein said plurality of resonators are arranged such that axes extending between said first and second ends of said resonators are parallel and not collinear.

4. The circuit of claim 1, wherein at least one of said first, second, and third resonators has a conical shape.

5. The circuit of claim 1, further comprising:

an enclosure housing said plurality of resonators.

6. The circuit of claim 5, wherein said enclosure is formed of a non-conductive material.

7. The circuit of claim 1, further comprising at least:

an adjustable conductive member positioned at least partially between said first and second resonators to affect cross-coupling between said first and second resonators.

8. The circuit of claim 7, further comprising at least:

a mounting member coupled to said third resonator for positioning said third resonator, wherein said mounting member and said conductive member are coaxial.

9. The circuit of claim 8, wherein a longitudinal axis of each of said mounting member and said conductive member is parallel to a longitudinal axis of said third resonator.

10. The circuit of claim 8, wherein said conductive member is a hollow conductive cylinder having an internally threaded surface and an externally threaded surface; and wherein said mounting member is a mounting cylinder having an externally threaded surface for mating with the internally threaded surface of said hollow conductive cylinder.

11. The circuit of claim 10, further comprising at least: an enclosure for housing said plurality of resonators, said enclosure having an internally threaded hole for mating with the externally threaded surface of said hollow conductive cylinder; wherein turning said mounting cylinder repositions said third resonator relative to said enclosure and turning said hollow conductive cylinder repositions said hollow conductive cylinder between said first and second resonators relative to said mounting cylinder to affect the cross-coupling between said first and second resonators.

12. The circuit of claim 8, wherein said mounting member is a hollow mounting cylinder having an internally threaded surface and an externally threaded surface; and wherein said conductive member is a conductive cylinder having an externally threaded surface for mating with the internally threaded surface of said hallow mounting cylinder.

13. The circuit of claim 12, further comprising at least: an enclosure for housing said plurality of resonators, said enclosure having an internally threaded hole for mating with the externally threaded surface of said hollow mounting cylinder; wherein turning said hollow mounting cylinder repositions said third resonator relative to said enclosure and turning said conductive member repositions said conductive member between said first and second resonators relative to said hollow mounting cylinder to affect the cross-coupling between said first and second resonators.

14. A dielectric resonator circuit comprising:

a plurality of resonators positioned relative to each other such that a field generated in each resonator couples to at least one other resonator, wherein each of a first and second of said plurality of resonators are adjacent a third of said plurality of resonators, wherein said first and second resonators are alternate resonators positioned such that a field in one of said first and second resonators cross-couples directly to the other of said first and second resonators;

an adjustable conductive member associated with said third resonator, said adjustable conductive member positioned at least partially between said first and second resonators, wherein movement of said conductive member affects the cross-coupling between said first and second resonators; and wherein the end of said third resonator is inverted relative to the ends of the first and second resonators.

15. The circuit of claim 14, wherein said first resonator and said pair of resonators each comprise a body formed of a dielectric material, said body having a first end and a second end displaced from each other in a direction perpendicular to a plane of said field, said second end being smaller than said first end, and said body varying in cross-sectional area between said first and second ends.

16. The circuit of claim 14, wherein said plurality of resonators are arranged such that axes extending between said first and second ends of said resonators are parallel and not collinear.

17. The circuit of claim 14, wherein at least one of said first, second, and third resonators is conical.

18. The circuit of claim 14, wherein said first, second, and third resonators are conical.

19. The circuit of claim 14, further comprising at least:

a mounting member coupled to said third resonator for positioning said third resonator, wherein said mounting member and said conductive member are coaxial to one another.

20. The circuit of claim 19, wherein said mounting member is a hollow mounting cylinder having an internally threaded surface and an externally threaded surface; and wherein said conductive member is a conductive cylinder having an externally threaded surface for mating with the internally threaded surface of said mounting member.

21. The circuit of claim 19, wherein said conductive member is a hollow conductive cylinder having an internally threaded surface and an externally threaded surface; and wherein said mounting member is a mounting cylinder having a externally threaded surface for mating with the internally threaded surface of said hollow conductive cylinder.

22. A dielectric resonator circuit comprising:

a plurality of dielectric resonators positioned relative to each other such that a field generated in each resonator couples to at least one other resonator, and a mounting member having a longitudinal axis coupled to a first of said plurality of dielectric resonators for positioning said first dielectric resonator, said mounting member positioned at least partially between a second and a third of said plurality of dielectric resonators; and a conductive member having a longitudinal axis, said conductive member being coaxial with and longitudinally movable with respect to said mounting member, wherein movement of said conductive member affects the cross-coupling between said second and third dielectric resonators, wherein said first, second, and third dielectric resonators each comprise a body formed of a dielectric material, said body varying in cross-sectional area along a longitudinal axis, and wherein said second and third resonators are longitudinally inverted relative to said first resonator.

23. The circuit of claim 22, wherein said first, second, and third dielectric resonators are conical.

24. The circuit of claim 22, wherein a longitudinal axis of each of said mounting member and said conductive member is parallel to a longitudinal axis of said first resonator.

25. The circuit of claim 22, wherein said mounting member is a hollow mounting cylinder having an interior surface and an exterior surface, said interior and exterior surfaces having threads; and wherein said conductive member is a conductive cylinder having a threaded exterior surface for mating with the threaded interior surface of said mounting member.

26. The circuit of claim 25, wherein turning said mounting member repositions said first dielectric resonator and turning said conductive member affects the cross-coupling between said second and third dielectric resonator.

27. The circuit of claim 22, wherein said conductive member is a hollow conductive cylinder having an interior surface and an exterior surface, said interior and exterior surfaces having threads; and wherein said mounting member is a mounting cylinder having a threaded exterior surface for mating with the threaded interior surface of said hollow conductive cylinder.

28. The circuit of claim 27, wherein turning said mounting cylinder repositions said first dielectric resonator and turning said hollow conductive cylinder affects the cross-coupling between said second and third dielectric resonators.

29. A dielectric resonator circuit comprising:

a plurality of resonators, wherein said plurality of resonators are positioned relative to each other such that a field generated in each resonator couples to an adjacent resonator, wherein each of a first and second of said plurality of resonators are adjacent a third of said resonators, wherein said first and second resonators are alternate resonators positioned such that a field in one of said first and second resonators cross-couples directly to the other of said first and second resonators;

an adjustable conductive member associated with said third resonator, said conductive member capable of being positioned at least partially between said first and second resonators to affect cross-coupling therebetween;

an enclosure housing said plurality of resonators and said adjustable conductive member, wherein said resonators and said adjustable conductive member are mounted to said enclosure;

at least a partial wall positioned between said first and second resonators, said partial wall having a gap through which said first and second resonators cross-couple, wherein said conductive member extends at least partially into said gap.

* * * * *